United States Patent [19]

Smith

[11] 4,376,920

[45] Mar. 15, 1983

[54] SHIELDED RADIO FREQUENCY TRANSMISSION CABLE

[76] Inventor: Kenneth L. Smith, 23 Barberry La., Meriden, Conn. 06450

[21] Appl. No.: 250,053

[22] Filed: Apr. 1, 1981

[51] Int. Cl.[3] ..... H01P 3/06

[52] U.S. Cl. ..... 333/12; 333/243; 174/36; 174/105 R

[58] Field of Search ..... 333/12, 243, 244; 174/36, 105 R, 115

[56] References Cited

U.S. PATENT DOCUMENTS

| | | | |
|---|---|---|---|
| 281,223 | 7/1883 | Rogers . | |
| 327,489 | 9/1885 | Spalding . | |
| 1,817,964 | 8/1931 | Carson et al. . | |
| 1,880,764 | 10/1932 | Buckley . | |
| 2,005,273 | 6/1935 | Studt . | |
| 2,015,476 | 9/1935 | Hunter . | |
| 2,322,971 | 6/1943 | Roosenstein . | |
| 2,376,101 | 5/1945 | Tyzzer | 333/243 X |
| 2,479,924 | 8/1949 | Gillis . | |
| 2,576,163 | 11/1951 | Weston et al. . | |
| 2,669,695 | 2/1954 | Bird . | |
| 2,769,149 | 10/1956 | Kreer, Jr. . | |
| 3,088,995 | 5/1963 | Baldwin . | |
| 3,163,836 | 12/1964 | Sugi et al. . | |
| 3,193,712 | 7/1965 | Harris | 174/36 UX |
| 3,215,768 | 11/1965 | Murphy . | |
| 3,351,706 | 11/1967 | Gnerre et al. . | |
| 3,379,824 | 4/1968 | Kempf . | |
| 3,484,679 | 12/1969 | Hodgson et al. . | |
| 3,509,266 | 4/1979 | Endacott . | |
| 3,541,473 | 11/1970 | Schlicke et al. | 333/243 X |
| 3,573,676 | 4/1971 | Mayer . | |
| 4,095,039 | 6/1978 | Thompson . | |
| 4,197,423 | 4/1980 | Fusen . | |
| 4,301,428 | 11/1981 | Mayer . | |

*Primary Examiner*—Paul L. Gensler

*Attorney, Agent, or Firm*—Charles Hieken

[57] ABSTRACT

The subject invention is directed to a cable comprising at least one center conductor, a dielectric surrounding said conductor and a plurality of metallic sheaths with at least two of said metallic sheaths separated, having a high series impedance and high propagation function for the path between said separated metallic sheaths. Said metallic sheaths are disposed in coaxial relationship to said at least one center conductor along the length of said cable. The cable design improves the shielding, suppression of EMI and RFI interference and minimizes the number and/or cost of the metallic sheaths required to obtain desired shielding.

21 Claims, 6 Drawing Figures

SHIELDED RADIO FREQUENCY TRANSMISSION CABLE

BACKGROUND OF THE INVENTION (1) Field of the Invention

The present invention is directed to cables having utility as radio frequency transmission lines and having improved shielding properties.

(2) Description of the Prior Art

It is known that in many applications a conventional cable having a center conductor surrounded by a single flexible coaxial sheath does not have sufficient shielding properties to provide adequate suppression of EMI or RFI interference. Accordingly, in another conventional cable a second flexible coaxial sheath which is a good conductor is positioned in concentric relation to the first coaxial sheath which is also a good conductor. These two sheaths are either in electrical contact or separated by an interlayer of dielectric material having a relatively low dielectric constant and a low dissipation factor. When this interlayer dielectric is used, the construction is commonly called a triaxial cable. In this conventional triaxial cable, the coaxial sheaths are separated to increase the series impedance of the path between the sheaths thereby improving radio frequency shielding. However, use of a dielectric material having a relatively low dielectric constant and a low dissipation factor results in a small propagation function (propagation constant) in the path between the sheaths thereby resulting in the shielding performance being length dependent. In such a cable the ratio of the propagation function in the path between the two sheaths and the propagation function in the path between the center conductor and the inner sheath is less than about 2.

Conventional cables utilizing more than two sheaths in electrical contact or with an interlayer of dielectric material having a relatively low dielectric constant and low dissipation factor or combinations of the same, are used to further improve the shielding. Some cables additionally employ metallic armors for mechanical protection of the cable and/or drain wires for ground connection which are laid over or under the coaxial sheath or sheaths.

In a conventional cable, the sheath or sheaths are made from conductive material such as, for example, braided conductive wire, solid metallic sheath, solid metallic tape, or laminate tape formed of metallic and plastic layers. Braided sheaths, typically made from braided aluminum or copper wire and having an optical coverage of greater than ninety percent of the surface area of the sheath, are used as shields to obtain more mechanical flexibility than is achieved with a solid sheath. However, the shielding of the braided sheaths is inferior to that of a solid sheath and results in a higher propagation attenuation of the internal Transverse Electromagnetic (TEM) signal due to an increase in the power loss ($I^2R$ loss) of the sheath. To improve the shielding of a cable, a plurality of braided sheaths are typically used.

The relatively low propagation attenuation achieved by using a solid conductive sheath can be obtained by using a laminate metallic and plastic tape as the inner sheath. A cable made with a laminate metallic and plastic tape has increased flexibility in comparison to a cable made with a solid metallic tape sheath. The laminate tapes have one or more very thin metallic layers adhered to thin plastic layers. The laminate tapes may be bonded or adhered to the adjacent parts of the cable. Compared to braided sheaths the laminate tape generally offers inferior low frequency shielding and superior high frequency shielding. More than one layer of laminate tape may be used to improve the shielding and drain wires may be laid over or under the laminate tapes to provide termination to the connector.

A combination of braided shields, solid metallic tapes and laminate tapes are used to improve the shielding. In many conventional cables more than two sheaths are required to provide sufficient shielding, resulting in an appreciable increase in cost and decrease in flexibility of the cable.

SUMMARY OF THE INVENTION

A cable in accordance with the present invention provides improved shielding which significantly decreases the EMI or RFI interference. The improved shielding is obtained by separating the conductive sheaths in a unique manner that increases the series impedance of the path between the sheaths and creates a very large propagation function for this path.

A cable in accordance with the present invention includes one or more center conductors. By "center" it is meant a conductor or conductors that extend generally along the longitudinal axis of the cable, but such conductor or conductors may be located off-center from the longitudinal axis of the cable. The preferred center conductor is a cylindrical wire having its axis coincident with the axis of the cable, but a helical or a twisted center conductor may be used. Any of the various known materials and manufacturing processes for constructing center conductors may be employed, for example, copper, aluminum, and copper-clad aluminum.

A dielectric surrounds the center conductor or conductors and separates it from an inner coaxial metallic sheath. The dielectric is composed of conventional known dielectric materials and made by conventional manufacturing processes. The dielectric is made of materials such as, for example, air, a polymer material such as polytetrafluoroethylene or polyethylene (foamed or unfoamed), laminates and any other known combination of materials and manufacturing processes conventionally employed for construction of dielectrics in coaxial cables.

At least two spaced-apart concentric metallic sheaths are used, and these sheaths are preferrably coaxial with the longitudinal axis of the cable. The center conductor or conductors may be concentric or eccentric with the metallic sheaths, depending upon their position within the dielectric.

The metallic sheaths may be constructed from conventional materials used as outer conductors or shields in coaxial or multiconductor cables, preferably copper, aluminum or metal and plastic laminates. The sheaths may be in the form of braids, helically or longitudinally wrapped structures such as tapes, ribbon or wire, or tubular structures. The sheaths may be flat or corrugated. Additionally, the sheaths may have drain wires associated with them. The sheaths may be bonded to the adjacent parts of the cable using, for example, an ethylene- acrylic acid copolymer cement. Each metallic sheath of the cable may be constructed differently.

The metallic sheaths are separated to increase the series impedance of the path between the sheaths, thereby improving the shielding. However, when this is done in the conventional prior art triaxial cable of the type using electrically good dielectrics and sheaths having a high conductivity, a very small propagation function for the triaxial path between the sheaths is obtained and the shielding performance of the cable becomes length sensitive. In accordance with this invention, an interlayer dielectric between the spaced-apart coaxial sheaths is used to create a very large propagation function for the path between the sheaths, thereby obtaining the desired high series impedance of the path and yet obtaining improved shielding that is not as length sensitive as prior art cables. These improved performance characteristics are provided by selecting the materials as well as the thicknesses and spacing of the materials of the interlayer dielectric and the concentric sheaths so as to obtain a very large propagation function in the path between the sheaths. In accordance with a preferred embodiment of the invention, the ratio of the propagation function in the path between the sheaths and the propagation function in the path between the center conductor and the inner sheath is greater than about 10 and more preferably greater than about 50 and most preferably greater than about 100. The propagation function in the triaxial path is dependent on factors including the resistance and inductance of each of the concentric sheaths and the conductance and capacitance of the dielectric therebetween.

An example of a cable in accordance with the present invention is one having two spaced apart sheaths, such as braided copper sheaths, each with a low resistance and having a radio-frequency dissipative/absorptive and high dissipation factor dielectric therebetween. Most preferably the dielectric material has a dielectric constant above about 2.3 and a dissipation factor above about 0.01. The dielectric may be made of an electrically good material such as polytetrafluoroethylene or polyethylene loaded with lossy pigment and/or compounds which create a radio-frequency dissipative/absorptive dielectric. The dielectric may alternatively be laminates of electrically poor and electrically good dielectric materials. If laminates of poor and good materials are used, it is preferred that the inner laminate near the inner sheath be the electrically poor one. The dielectric material may have a large dielectric constant as a characteristic of the material or as a result of loading.

Another example of a cable having a high propagation function in the triaxial path is one in which one or more of the metallic sheaths are electrically poor conductors and are separated by electrically good dielectric. Preferably the inner metallic sheath, or its inner service, is an electrically good conductor so that the propagation attenuation of the internal TEM signal is not large. Therefore, this sheath may be a laminate of good conductor and poor conductor.

More than two sheaths may be used with at least one path having a high series impedance and propagation function.

From the foregoing it should be apparent that the metallic sheaths and intermediate dielectric of the invention may take the form of numerous, different embodiments. The crucial feature in all embodiments is a separation of at least two metallic sheaths to raise the series impedance of the path between the sheaths and the selection of the materials, the configuration and the sizes of the sheaths and the interlayer dielectric to thereby create a high propagation function for the triaxial path between these sheaths.

The advantages and structure of a cable in accordance with the invention will be described hereinafter in detail with reference to the drawings.

BRIEF DESCRIPTION OF THE DRAWINGS

The objects and advantages of the present invention are apparent when taken in conjunction with the accompanying drawings in which like characters of reference designate corresponding materials and parts throughout the several drawings thereof, in which.

DESCRIPTION OF THE PREFERRED EMBODIMENTS

The following description illustrates the manner in which the principles of the invention are applied, but is not to be construed as limiting the scope of the invention.

Figure 1:
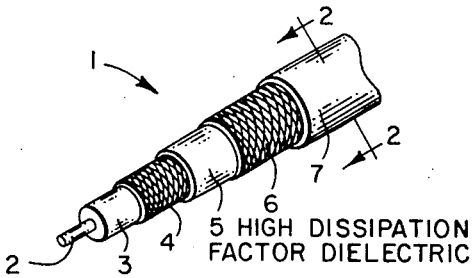
FIG. 1 depicts a cable in accordance with the invention in which layers have been partially cut away for illustration.
Figure 2:
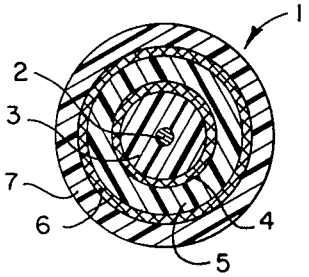
FIG. 2 is a cross-section along the plane 2—2 of the cable depicted in FIG. 1.

FIGS. 1 and 2, 3 and 4, and 5 and 6 illustrate several preferred embodiments of the invention. Referring to FIGS. 1 and 2, a triaxial cable 1 includes a center conductor 2, which is preferably a copper covered steel wire, surrounded by a cylindrical layer of dielectric material 3, which is preferably extruded foamed polyethylene. The inner metallic sheath 4 is a copper braid having ninety-six percent optical coverage. An intermediate dielectric layer 5 is preferably loaded polyethylene extruded over the copper braid sheath 4. The outer metallic sheath 6 is also a copper braid. In order to provide a cable having a high propagation function in the triaxial path between the two braids, the intermediate dielectric layer 5 is a radio frequency absorptive/dissipative material having a high dissipation factor. A preferred dielectric material is a loaded thermoplastic compound, and one such material is sold by Union Carbide Corporation under the designation BAKELITE DHDA-7704 BLACK 55.

The cable described with respect to FIGS. 1 and 2 has a relative high ratio between the propagation function in the triaxial path and the propagation function in the path between the center conductor 2 and the inner sheath 4 (inner braid). The thickness of the intermediate dielectric layer 5, the braid coverage and design are selected to achieve the desired shielding. Outer jacket 7, which is extruded over the outer braid 6 completes the cable. The jacket material is preferably black polyethylene.

Figure 4:
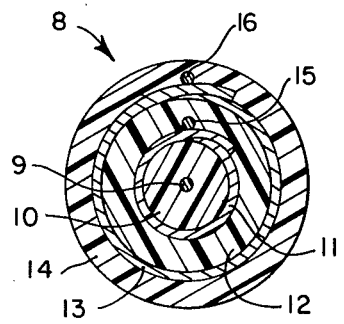
FIG. 4 is a cross-section along the plane 4—4 of the cable depicted in FIG. 3.
Figure 3:
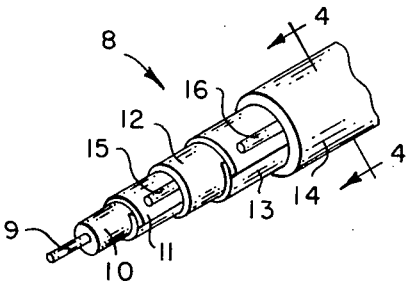
FIG. 3 depicts a second cable designed in accordance with the invention in which layers have been partially cut away for illustration.

FIGS. 3 and 4 show another triaxial cable 8 comprised of center conductor 9 and dielectric 10 identical to those described in FIGS. 1 and 2. The inner and outer metallic sheaths 11 and 13 are longitudinally pulled laminate tapes, typically referred to as "cigarette-wrapped" tapes, with tinned copperweld drain wires 15 and 16 extending the length of the cable. The laminate tapes 11 and 13 are conventional aluminum-polypropolene-aluminum tapes. The inner laminate tape 11 is adhered to the intermediate dielectric 10 with an ethylene-acrylic acid copolymer cement. The drain wires 15 and 16 are placed respectively over the laminate tapes 11 and 13 and are in metallic contract with them. In order to provide a high propagation function in the path between the two tapes 11 and 13, the intermediate dielectric layer 12 is highly absorptive/dissipative and has a high dissipation factor and preferably has the same composition as dielectric layer 5 described with respect to FIGS. 1 and 2. The amount of overlap of the laminate tapes 11 and 13, the thickness of the intermediate dielectric layer 12 and thickness of the metal in the laminate tapes are selected to achieve the desired shielding. Outer jacket 14 is preferably extruded over tape 13 and is preferably made from black polyethylene.

Figure 5:
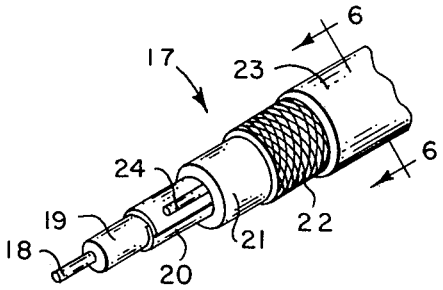
FIG. 5 depicts a third cable designed in accordance with the invention in which layers have been partially cut away for illustration.
Figure 6:
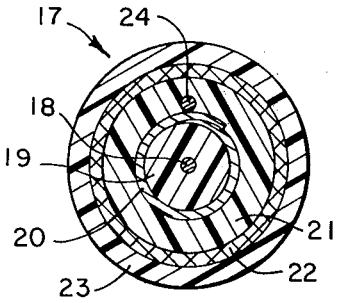
FIG. 6 is a cross-section along the plane 6—6 of the cable depicted in FIG. 5.

FIGS. 5 and 6 show a triaxial cable 17 comprising center conductor 18, dielectric 19, inner metallic sheath 20, intermediate dielectric 21, outer metallic sheath 22 and outer jacket 23. This cable is constructed in the same manner as the cable of FIGS. 1 and 2 with the following exceptions: The metallic sheath 20 is a longitudinally pulled "cigarette-wrapped" laminate tape with drain wire 24. The laminate tape 20 has the same construction as laminate tapes 11 and 13 of FIGS. 3 and 4 and is adhered to dielectric 19 by an ethylene-acrylic acid copolymer cement. In order to provide a high propagation function in the path between the laminate tape 20 and the braid 22, the dielectric layer 19 is a radio-frequency dissipative/absorptive dielectric having a high dissipation factor, and preferably has the same composition as dielectric 5 described with respect to FIGS. 1 and 2. The metallic sheath 22 is an aluminum braid having an optical coverage of about ninety-six percent. The overlap of the laminate tape, the thickness of the metal in the laminate tape, the thickness of the intermediate dielectric layer, the braid coverage and design are selected to achieve the desired shielding.

With respect to each of the cables described by reference to FIGS. 1 and 2, FIGS. 3 and 4 and FIGS. 5 and 6, they provide for a large propagation function in the triaxial path between the two metallic coaxial sheaths. Preferably, the propagation function in the triaxial path is at least 10 times, more preferably 50 times, and most preferably 100 times, the propagation function in the path between the center conductor and the inner sheath. As can be appreciated by one skilled in the art, this large ratio can be obtained by selecting the materials, design and sizes for the metallic coaxial sheaths and/or intermediate dielectric between these sheaths so that this large propagation function is obtained.

EXAMPLE

A detailed example of a cable in accordance with the present invention will now be described. The cable of this example is of the type described with respect to FIGS. 1 and 2. The center conductor 2 is a copper covered steel wire having a 0.032 inch diameter. Dielectric layer 3 is extruded foamed polyethylene having a 0.146 inch outer diameter. This particular dielectric material, which is a conventional dielectric material, is believed to have a dielectric constant of about 1.6 and a dissipation factor of about 0.0003. The inner sheath 4 is formed of a 34-AWG copper braid having ninety-six percent optical coverage. Intermediate dielectric layer 5 has a 0.025 inch radial thickness and is a radio-frequency absorptive/dissipative loaded polyethylene. This material is sold by Union Carbide Corporation under the designation BAKELITE DHDA-7704 BLACK 55. Outer sheath 6 is the same as inner sheath 4. The jacket 7 is 0.025 inch thick extruded polyvinylchloride.

A significant improvement is obtained in the shielding of the cable of the above described example in comparison with a prior art cable identical in construction to that of this example except using a conventional polyethylene dielectric layer between the sheaths having a low dielectric constant of about 2.3 and a low dissipation factor of about 0.00025. For a cable having a length of 200 meters, a calculated theoretical improvement of 40 to 80 db would be obtained over the frequency range of 5 $MH_z$ to 400 $MH_z$, the cable television frequency range. A cable having a length of 10 meters would have a calculated theoretical improvement of 10 to 20 db in this frequency range. The cable of this example provides improved shielding by providing a large propagation function in the triaxial path between the two sheaths. In the cable of the example, the propagation function in the triaxial path is calculated to be greater than 10 times the propagation function in the path between the center conductor and the inner sheath.

From the foregoing, it should be apparent that the cable of the invention may take the form of numerous, different embodiments. The crucial feature in all embodiments is the requirement of a plurality of metallic sheaths with at least two sheaths separated with a dielectric to raise the series impedance of the paths between the sheaths and constructed in a manner to create a high propagation function for this triaxial path. Though the cable of the invention has been illustrated using longitudinally pulled "cigarette-wrapped" laminate metal tapes, metallic braids and loaded polyethylene intermediate dielectric layers, those of skill in the art will appreciate that various metallic sheaths and intermediate layers may be used in forming a cable in accordance with the invention and that different metallic sheaths may be used with different intermediate layers to create a high series impedance and a propagation function for the path between at least two of the sheaths.

The unique construction of separated metallic sheaths and dielectric therebetween achieves a high series impedance and high propagation function in the path between the sheaths, remarkably improving the shielding over conventional sheaths either in electrical contact or separated by a dielectric having a low dielectric constant and a low dissipation factor thereby creating a small propagation function. Hence, the improved cable shielding suppresses the EMI and or RFI interference. The cable of the invention also minimizes the number of sheaths or allows use of less expensive poorer shielding sheaths (for example, braids with lower optical coverage) to achieve the same cable shielding, resulting in decreased manufacturing costs.

While the invention has now been described in terms of certain preferred embodiments, and exemplified with respect thereto, those of skill in the art will readily appreciate that various modifications, changes, omissions and substitutions may be made without departing from the spirit of the invention.

What is claimed is:

1. A cable for radio-frequency transmission comprising at least one center conductor, a dielectric surrounding said conductor, and at least two generally concentric separated inner and outer metallic sheaths defining an outer transmission path therebetween having a first propagation function, said center conductor and said inner metallic sheath defining an inner transmission path therebetween having a second propagation function, said first propagation function being significantly greater than twice said second propagation function to significantly attenuate radiation from said cable.

2. A cable as defined by claim 1, wherein said first propagation function is at least 10 times said second propagation function.

3. A cable as defined by claim 2, wherein said first propagation function is at least 50 times said second propagation function.

4. The cable as defined by claim 1, wherein a dielectric is positioned between said sheaths.

5. The cable as defined by claim 4, wherein said dielectric between said sheaths is a radio-frequency dissipative/absorptive material having a dielectric constant above about 2.3 and a dissipation factor above about 0.01.

6. The cable as defined by claim 4, wherein said dielectric between said sheaths is a loaded dielectric material.

7. The cable as defined by claim 2, wherein at least one of said separated metallic sheaths is a metallic and plastic laminate.

8. The cable as defined by claim 7, wherein said laminate sheath includes an adhesive on at least one side which adheres it to at least one adjacent layer in said cable.

9. The cable as defined by claims 1 or 7, wherein at least one of said metallic sheaths is a longitudinal pulled cigarette-wrapped metal tape.

10. The cable as defined by claims 1 or 2, wherein at least one of said metallic sheaths is a metallic braid.

11. The cable as defined by claim 1 and further comprising an outer jacket.

12. A triaxial cable for radio frequency transmission comprising a cylindrical center conductor, a cylindrical dielectric surrounding said center conductor, an inner metallic sheath disposed along said dielectric in coaxial relation to said center conductor defining an inner transmission path therebetween having a second propagation function, an intermediate dielectric surrounding said inner metallic sheath, and an outer metallic sheath disposed along said intermediate dielectric layer in coaxial relation to said center conductor, said cable having a triaxial path between said sheaths having a first propagation function significantly greater than twice said second propagation function to significantly attenuate radiation from said cable.

13. A cable as defined by claim 12, wherein said first propagation function is at least 10 times said second propagation function.

14. A cable as defined by claim 13, wherein said first propagation function is at least 50 times said second propagation function.

15. The triaxial cable as defined in claim 12, wherein the inner of said metallic sheaths is a laminate metallic and plastic tape wherein the outer metallic sheath is a metallic braid.

16. The triaxial cable as defined by claim 15, wherein said dielectric between said metallic sheaths is a loaded dielectric material.

17. The triaxial cable as defined by claim 12, wherein each of said metallic sheaths is a laminate plastic and metallic tape.

18. The triaxial cable as defined by claim 17, wherein said material between said metallic sheaths is a loaded dielectric.

19. The triaxial cable as defined by claim 12, wherein each of said metallic sheaths is a metallic braid.

20. The triaxial cable as defined by claim 19, wherein said dielectric between said metallic sheaths is a loaded dielectric.

21. The triaxial cable as defined by claim 12 and further comprising an outer jacket.

* * * * *